United States Patent [19]

Kalman

[11] Patent Number: 4,511,630

[45] Date of Patent: Apr. 16, 1985

[54] METHOD FOR SCULPTING PAPERWEIGHT OF ATTRACTIVE APPEARANCE

[76] Inventor: Tibor Kalman, 157 W. 57 St., New York, N.Y. 10019

[21] Appl. No.: 581,053

[22] Filed: Feb. 17, 1984

[51] Int. Cl.[3] ..... B44C 3/06

[52] U.S. Cl. ..... 428/542.2; D19/97; 40/358; 156/85

[58] Field of Search ..... D19/96, 97; 40/10 D, 40/358; 248/504, DIG. 10; 428/542.2, 542.4, 542.8; 156/85

[56] References Cited

U.S. PATENT DOCUMENTS

| | | | |
|---|---|---|---|
| 1,640,987 | 8/1927 | Gray | 428/542.8 X |
| 2,529,945 | 11/1950 | Hyman | 428/542.2 X |
| 2,987,103 | 6/1961 | Yakubik | 428/203 |
| 3,723,221 | 3/1973 | Hayashi | 428/192 X |
| 3,847,721 | 11/1974 | Evans | 428/542.2 X |
| 3,910,330 | 10/1975 | Johnson et al. | 428/900 X |
| 3,924,212 | 12/1975 | Brown | 428/900 X |
| 3,926,471 | 12/1975 | Nadasi et al. | 428/900 X |
| 4,264,010 | 4/1981 | Yoshiga et al. | 428/36 X |
| 4,398,643 | 8/1983 | Conlon | 248/DIG. 10 X |

*Primary Examiner*—Henry F. Epstein
*Attorney, Agent, or Firm*—Peter L. Berger

[57] ABSTRACT

A method is disclosed for forming a paperweight which has the resultant sculpted form of a crumpled sheet of paper. The method includes the steps of heating a vinyl sheet until it is soft and pliable and wrapping that sheet about a metal weight to take the above mentioned rigid form when it is cooled down.

9 Claims, 3 Drawing Figures

FIG. 1
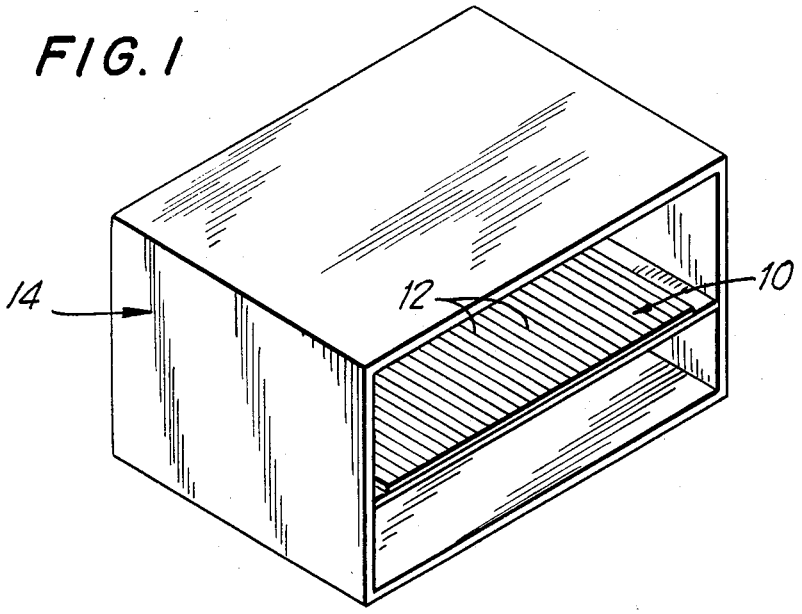
FIG. 2
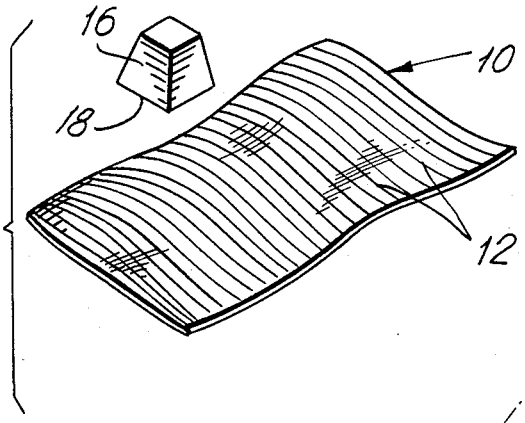
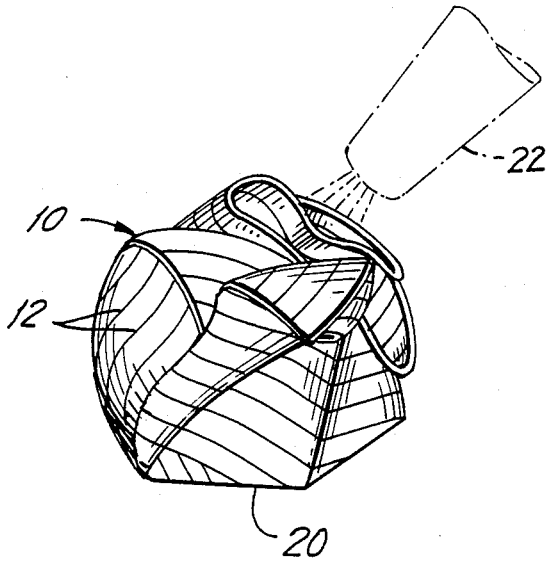
FIG. 3

METHOD FOR SCULPTING PAPERWEIGHT OF ATTRACTIVE APPEARANCE

BACKGROUND OF THE INVENTION

This invention relates to a method of forming sculptural art works, and more particularly, to a method of forming artistic sculpted paperweights.

The method comprises the steps of selecting a plastic sheet of material, heating the sheet so that it is in a flowable condition enabling it to be crumpled while retaining its general shape, crumpling the sheet around a heavy metallic object to form a crumpled paper shape and quickly cooling the crumpled sheet to retain its crumpled shape when cooled down. A whimsical paper weight is then formed, and in one embodiment, the sheet is to be printed on yellow lined paper, so that the resulting crumpled paperweight takes the form of a crumpled legal yellow sheet of paper.

An object of this invention is to provide a method of forming paperweights which is easy to carry out, inexpensive and which yields attractive paperweights.

Another object of this invention is to provide such a method which is readily adaptable to producing sculpted forms for other products.

Yet another object of this invention is to provide such a method which may be practiced by amateurs as well as professional sculptors and which lends itself to a new art form for sculpted materials.

Still another object of this invention is to provide such a method which can produce products which can be directed at special markets by customizing the materials used in the method of this invention.

Other objects, advantages and features of this invention will become more apparent hereinafter.

SUMMARY OF THE INVENTION

In accordance with the principles of this invention, the above objects are accomplished by providing an opaque rigid sheet of vinyl plastic material of approximately 0.030 inches thickness, printing a desired pattern on said sheet as by silk screening or the like, heating the sheet until it is soft and pliable, placing a rigid or semi-rigid object within said soft sheet, crumpling said sheet about said object to a desired form and cooling the crumpled formed sheet to retain said shape after the process is completed.

In one preferred form of the invention, a yellow color lined with blue lines is printed on the sheet to appear like a yellow legal pad. The object about which the sheet is crumpled is a heavy small metallic object such as lead and the resultant structure serves as an excellent paperweight with the bottom flat surface of the lead piece forming the bottom of the paperweights.

The object about which the soft sheet is sculpted may be of different characteristics. For instance, the metallic object may be magnetic and the sculpted finished product may serve as a decorative small magnet. Printing of designs on the vinyl sheet allows for personalization, such that musical composition, peoples' faces, etc. may be printed on the vinyl sheet for later "crumpling".

BRIEF DESCRIPTION OF THE DRAWINGS

FIG. 1 is a perspective view of the printed vinyl sheet being placed in an oven to be heated.

FIG. 2 is a perspective view of the vinyl sheet in its heated state when it is soft and pliable being removed from the oven and of the metal weight about which the vinyl sheet is sculpted.

FIG. 3 is a perspective view of the sculpting or crumpling of the soft vinyl sheet about the metal weight with a phantom nozzle cooling the sculpted piece setting the soft vinyl in the desired sculpted shape.

DETAILED DESCRIPTION

The sheet which may be used with this invention may be an opaque rigid vinyl of 0.030 inches. Other plastic materials may be used with the primary objective that the plastic is capable of being heated to be soft and pliable, then molded and quickly cooled to set in a desired sculpted shape. Materials such as styrene and plexiglas may also be employed.

The opaque vinyl sheet 10 is capable of being printed, and in one preferred embodiment the vinyl sheet is printed yellow with blue parallel lines 12 on both sides. The vinyl sheet is placed in an oven 14 and is heated to approximately 300° F. (FIG. 1) or until it is soft and pliable. A small piece of dense material such as lead 16 serves as the weight of the paperweight and the pliable soft vinyl sheet 10 is wrapped and sculpted about the lead weight 16, enclosing the weight. (FIG. 3) The bottom surface 18 of the weight is flat, and the vinyl material conforms to this bottom flat surface permitting the paperweight to have a flat bottom 20. While the vinyl sheet 10 is soft and pliable it is worked or sculpted to its desired shape. A cooling apparatus 22 (FIG. 3) is employed to quickly cool down the vinyl material to retain its sculpted shape. When so cooled, rigid sculpted form is produced, and in the preferred embodiment discussed above the sculpted form takes the shape of a crumpled piece of a yellow legal sheet of paper. The paperweight produced is aesthetically attractive, easy to sculp, of inexpensive materials and extremely desirable. The final form is so life-like that it has been reported that some of the products produced by this method have been discarded because someone thought it was just a crumpled sheet of paper.

Other printing may be utilized to customize the sculpted paperweight.

Other materials may be employed as the heavy object. Such materials could include dense plastics having a higher melting point than that of the vinyl mineral, rocks or other materials. Additionally, the material could be magnetic and could be used as a decorative magnet.

Although the method of this invention has been described with one preferred embodiment, other variations and embodiments may be developed by those skilled in the art without departing from the teaching or scope of protection of this invention.

I claim:

1. A method for forming a sculpted paperweight having the appearance of crumpled paper, the method comprising the steps of selecting a metal weight having a flat bottom, selecting a rigid vinyl sheet of material, printing desired patterns on said vinyl sheet, heating said vinyl sheet until it is soft and wrapping said vinyl sheet in said soft and pliable condition around said metal weight to enclose said metal weight and conform the vinyl sheet to the flat bottom of the metal weight, manually sculpting the soft pliable vinyl sheet to a desired appearance, and cooling said soft pliable vinyl in its desired appearance to form a rigid sculpted paperweight.

2. A method for forming a sculpted paperweight according to claim 1, wherein said pattern on said vinyl sheet is silk screened onto said vinyl sheet.

3. A method for forming a sculpted paperweight according to claim 1, wherein said vinyl sheet is an opaque rigid vinyl material.

4. A method for forming a sculpted paperweight according to claim 2, wherein said rigid vinyl sheet is a rectangle.

5. A method for forming a sculpted paperweight according to claim 2, wherein the thickness of said vinyl sheet is approximately 0.030 inches.

6. A method for forming a sculpted paperweight according to claim 1, wherein said vinyl sheet is heated to approximately 300° F.

7. A method for forming a sculpted paperweight according to claim 1, wherein said metal weight comprises a magnetic material.

8. A method for forming a sculpted paperweight according to claim 3, wherein said printed vinyl sheet has the appearance of a legal sheet of paper and said paperweight takes the apperance of a crumpled piece of sheet of a yellow legal pad.

9. The sculpted paperweight produced by the method of claim 1.

* * * * *